United States Patent [19]

Hinds

[11] Patent Number: 4,779,867

[45] Date of Patent: Oct. 25, 1988

[54] ELASTIC CABLE EXERCISER

[75] Inventor: Robert S. Hinds, Dane County, Wis.

[73] Assignee: Lifeline International, Inc., Redmond, Wash.

[21] Appl. No.: 880,624

[22] Filed: Jul. 1, 1986

[51] Int. Cl.[4] ..... A63B 21/02

[52] U.S. Cl. ..... 272/137; 272/142; 272/143; 272/900

[58] Field of Search ..... 272/67, 93, 125, 133, 272/135-143, 900, DIG. 4

[56] References Cited

U.S. PATENT DOCUMENTS

| | | | |
|---|---|---|---|
| Re. 28,066 | 7/1974 | Marcyan . | |
| 3,117,781 | 1/1964 | Vargo | 272/125 |
| 3,256,015 | 6/1966 | Perrin | 272/136 |
| 3,355,171 | 11/1967 | Oesau | 272/125 |
| 3,971,555 | 7/1976 | Mahnke . | |
| 4,059,265 | 11/1977 | Wieder et al. | 272/137 |
| 4,195,835 | 4/1980 | Hinds et al. | 272/137 |
| 4,200,280 | 4/1980 | Goodwin . | |
| 4,245,839 | 1/1981 | Trent | 272/900 X |
| 4,316,610 | 2/1982 | Hinds | 272/137 |
| 4,326,708 | 4/1982 | Hinds | 272/138 |
| 4,328,964 | 5/1982 | Walls | 272/136 |
| 4,419,990 | 12/1983 | Forster | 272/900 X |
| 4,593,902 | 6/1986 | Michaelsen | 272/900 X |

FOREIGN PATENT DOCUMENTS

| | | | |
|---|---|---|---|
| 267383 | 12/1968 | Austria | 272/142 |
| 1802516 | 5/1970 | Fed. Rep. of Germany | 272/142 |
| 556672 | 12/1974 | Switzerland | 272/137 |

*Primary Examiner*—Richard J. Apley
*Assistant Examiner*—Robert W. Bahr
*Attorney, Agent, or Firm*—Seed and Berry

[57] ABSTRACT

An elastic cable having stirrups fixed to each end and an elongated bar having ends that receive a central portion of the cable and hold the stirrups separated one from another during use. Each end of the bar is provided with a U-shaped yoke that guides the cable from the bar. The yoke guide is provided with projections that retain the cable in the guides, particularly when the cable is slack. Opposed lugs also project from the bar ends such that cable wrapped circumferentially about the bar ends for tensioning the cable are prevented form slipping off the ends of the bar during exercise. The bar end is also provided with receptacles having surfaces that engage the stirrups to secure the stirrups in frictional contact with the bar, particularly useful for some exercises. Additionally, the exerciser includes an improved door attachment device that greatly improves the versatility and usefulness of the exerciser.

7 Claims, 2 Drawing Sheets

FIG. 3
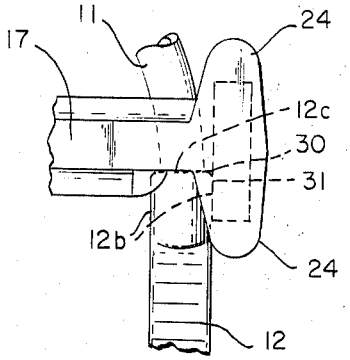
FIG. 4
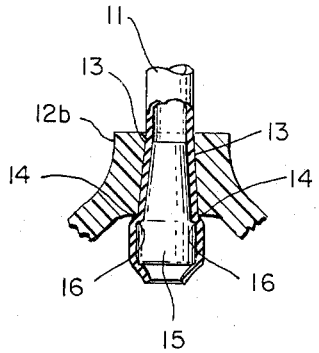
FIG. 5
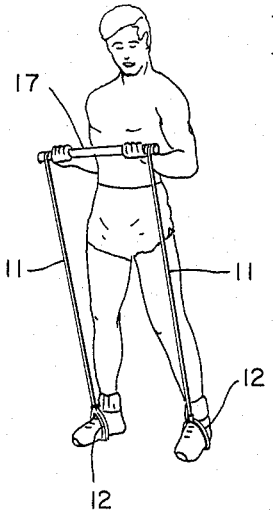
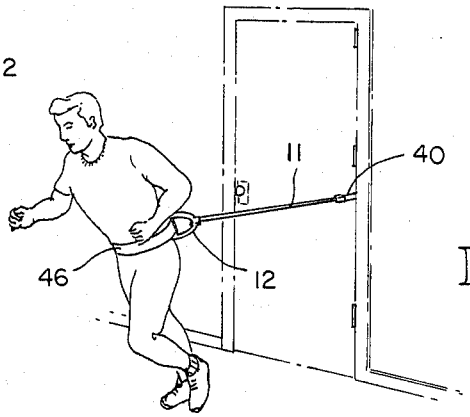
FIG. 6

ELASTIC CABLE EXERCISER

TECHNICAL FIELD

The invention is related to exercise apparatus that include a resilient elastic cable, an elongated bar that engages a central portion of the cable and stirrups secured to the ends of the cable. Such devices are particularly useful because resistance increases as a user stretches the cable. The increasing resistance provides a reasonably constant overall benefit for a particular movement, offsetting momentum and lever arm advantages that reduce the effectiveness of conventional weight lifting in the course of an exercise movement such as a curl.

BACKGROUND OF THE INVENTION

The apparatus of the invention is an improvement over the exercising apparatus and methods described by the present inventor in his prior patents, U.S. Pat. Nos. 4,326,708, 4,195,835 and 4,316,610. In U.S. Pat. No. 4,326,708, Hinds focuses upon a method for tensioning the elastic cable of the afore-described cable-bar-stirrups exercise device by wrapping the cable a number of turns about each end of the bar by simply rotating the bar with the stirrups attached to the ends of the cable held fixed. Hinds et al. in U.S. Pat. Nos. 4,195,835 and Hinds in 4,316,610 describe particular embodiments of the exerciser, including useful elements such as bar end fittings that comprise finger-like members configured as bifurcations that permit the cable to pass therethrough and about which the cable is wrapped to adjust tension. Other variations of the present type of exerciser are described by Perrin in U.S. Pat. Nos. 3,256,015 and Wieder et al., in 4,059,265, both of which also include a provision for attaching the elastic cable element to a door frame. Another exerciser of interest is described by Vargo in U.S. Pat. No. 3,117,781.

DISCLOSURE OF THE INVENTION

The present invention is an improvement over the prior devices and permits easier and safer operation of the exerciser. Additionally, the improvements increase the versatility of the exerciser.

The improvements, in general, restrain the elastic cable and stabilize positioning of the exerciser elements during preparation of the exerciser for a particular exercise. The restraining improvements particularly enhance safety of operation, for example, preventing slippage of the tensioned cable over the end of the bar during operation. The addition of an improved door attachment device and receptacles for securing the stirrups to the bar permit a wide variety of new exercises to be performed.

The exercise apparatus includes a resilient, longitudinally stretchable elastic cable. Each end of the cable is fastened to a stirrup. An elongated bar is provided that preferably includes a longitudinal groove along one surface thereof for receiving a central or intermediate section of the elastic cable. Each end of the bar is provided with a U-shaped yoke that receives the cable and guides the cable about the bar ends such that the stirrups are held in a separated position. A pair of projections in the yoke opening allow the resilient cable to squeeze between them into the yoke and retain the cable in the yoke, particularly when the cable is unstressed during setup of the exerciser for an exercise. The yoke also preferably includes opposed lugs that project from the bar that insure that the cable, when under tension does not slip over the bar ends during exercise. The bar is additionally provided with receptacles or sockets at either end of the bar in alignment on one side of the bar, preferably opposite the longitudinally grooved surface. The receptacles at the ends of the bar are aligned with and adjacent the cable retaining yoke such that each receptacle of socket receives and engages stirrup surfaces to hold the stirrup fixed to the bar when the cable is unstressed. The stirrup receptacles help stabilize the exerciser during positioning of its elements during setup for an exercise.

The exerciser of the invention is provided with a door attachment that includes a substantially rigid extension member having a first aperture at one end for receiving the cable and a second aperture at its opposite end. The door attachment also includes a flexible door jamb attachment strap having a loop at one end for securing the strap to the second aperture in the rigid member, and at its opposite end, an enlargement. The enlargement is of such size and configuration that it may be inserted between and beyond an open door and door jamb such that upon closing of the door, the enlargement prevents the strap from pulling free of the closed door and door jamb. Preferably, the enlargement is a cylinder shape sewn into an end loop of the jamb attachment strap.

BRIEF DESCRIPTION OF THE DRAWINGS

FIG. 3 is a partial elevation view of the invention showing a stirrup held fixed to the bar at the cable yoke.

FIG. 4 is a partial section view showing how the cable is fastened to the stirrup.

FIG. 5 shows a conventional use of the exercise apparatus of the invention.

FIG. 6 shows a new use for the exercise apparatus of the invention utilizing the door attachment element.

BEST MODE FOR CARRYING OUT THE INVENTION

Figure 1:
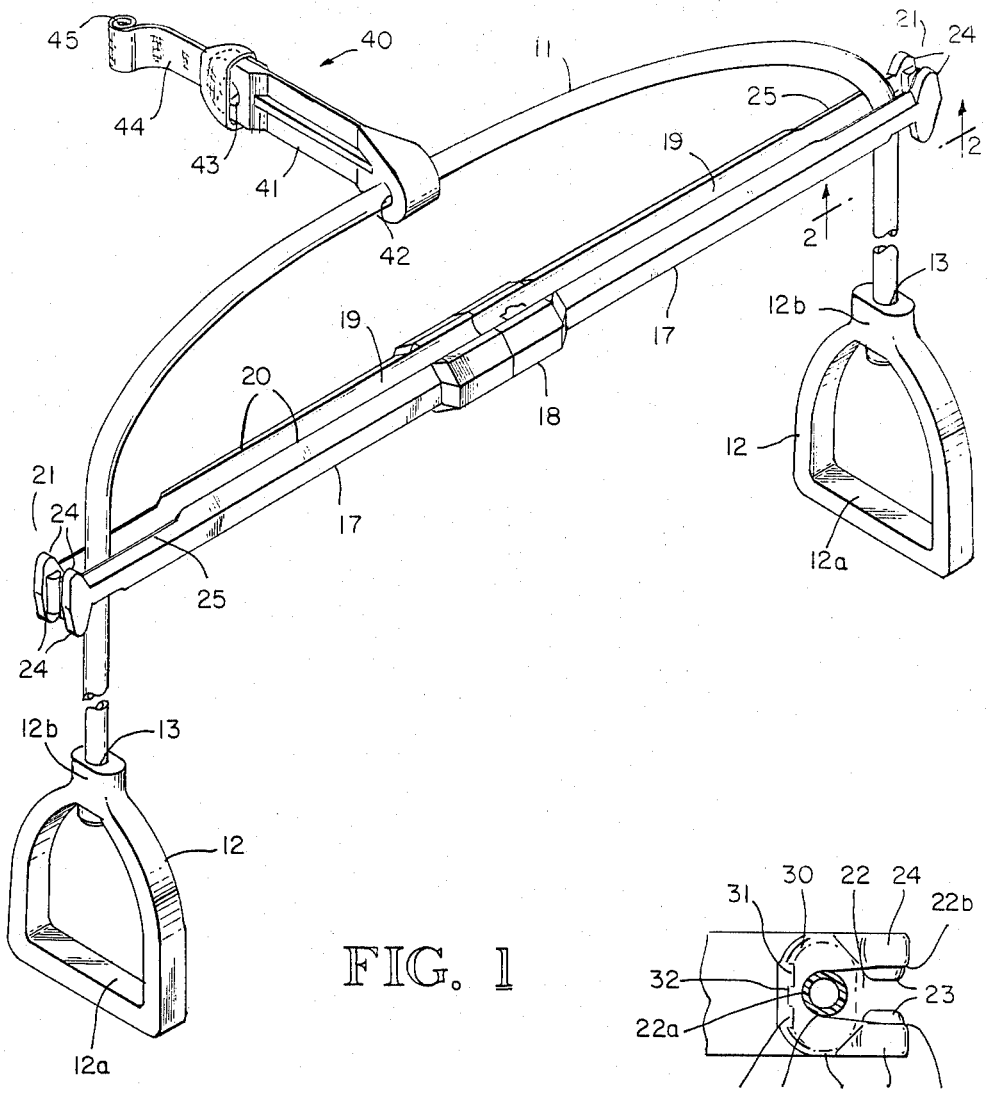
FIG. 1 is an isometric view of the exercise apparatus of the invention, including a door attachment element with the opposite surfaces of the rigid component of the door attachment being the mirror image of those shown.

Referring to FIG. 1, the exercise apparatus 10 of the invention is shown. The exerciser includes a resilient cable 11 that is longitudinally elastically stretchable. The cable 11 is preferably an elastic tubing made of a material having a tensile strength of above 3,000 psi and an elongation characteristic above 700%.

Each end of the elastic cable 11 is attached to a stirrup 12. The stirrup 12 includes a surface **12*a* that is engaged by a user's foot or hand and an upper portion 12*b* for attachment to the cable 11. The stirrup includes an aperture 13 through which the cable passes and is secured in place by contact with stirrup surface 14 and a plug 15, as described below in more detail with reference to FIG. 4**.

Referring once again to FIG. 1, the exercise apparatus of the invention includes a bar 17, preferably formed in halves that lock together by means of a suitable locking mechanism 18 (not shown in detail). The bar 17 preferably includes a longitudinal slot or groove 19 extending along its length for receiving and supporting the resilient elastic cable 11 during certain exercises. Preferably, the groove includes retaining lips 20 such that when the resilient cable is pressed into the groove it is retained in the groove by the lip surface.

Figure 2:
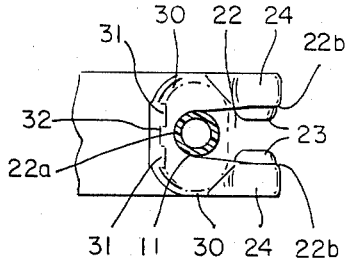
FIG. 2 is a partial plan view of the exerciser showing the cable yoke element of the invention with a stirrup held within a receptacle.

Each end of the bar 17 is provided with a yoke 21 that guides the cable 11. The yoke arrangement 21 is shown in detail in FIGS. 1—3. In the FIG. 2 plan view, the yoke includes a substantially U-shaped opening 22 such that the cable is received by the bottom portion 22*a* of the U. Outwardly extending finger members or arms 22*b* of the U assist in retaining and guiding the cable 11. The yoke 21 is provided with a pair of projections 23 that extend inwardly from the yoke arms 22*b* and prevent the cable from pulling out of the yoke arms 22*b*, particularly when the cable is untensioned. Having the cable securely contained by the guide yoke 21 assists the user during arrangement of the exerciser elements preparatory to performing a set of exercises when there is no tension on the elastic cable.

The yoke 21 also includes projecting lugs 24, best shown in FIGS. 1 and 3, that project substantially opposed from the bar 17. Tensioning the cable for a particular exercise is preferably accomplished by wrapping the cable a turn or more circumferentially about each end of the bar. The projecting lugs 24 prevent a cable, wrapped about the lifting bar for tensioning, from slipping off the ends during an exercise. The lugs extend sufficiently to effectively retain an adjacently wrapped cable that is tensioned. These retaining lugs are an important advantage during exercise as a matter of safety.

Wall sections forming the groove retaining lips 20 on the bar are preferably reduced in height adjacent each bar end to provide a relatively smooth area 25 which forms a depression for receiving the circumferentially wrapped cable. The reduced height, smooth area 25, in combination with the retaining lugs 24, helps facilitate and retain wrapping of the cable about the bar for tensioning the cable with less danger that the cable will slip over the bar ends during exercise.

The bar 17 is also provided with receptacles 30 that are preferably located at each end of the bar and secure the stirrups to the bar with the cable passing through the yoke 21. Such positioning of the bar and stirrups is a requirement of some exercises, such as the standing chest presses, triceps pushdowns, and the like. The receptacle or socket is preferably cut or formed into the bar to receive the stirrup. One wall of the receptacle is formed by a surface of the projecting lugs 24. Preferably, the lugs 24 are formed in pairs having surfaces arranged to engage the throat surfaces 12*b* of the stirrup. The opposite wall of the receptacle is preferably made by forming opposing surfaces spaced opposite the lugs 24 such that the opposite side of the stirrup throat surfaces 12*b* are engaged. The bottom of the receptacle is flat, engaging the flat top surface 12*c* of the stirrup. Each receptacle preferably includes a pair of spaced projecting pads 31 separated by a groove 32. The pads 31 engage the throat surfaces 12*b* on the stirrups 12 to hold the stirrups fixed to the bar. The throat 12*b* of the stirrup may be tapered to more positively engage the receptacle surfaces. The pads 31 are preferably shaped to compliment the throat surfaces to further increase the stability of the arrangement. Preferably, the resiliency of the pads 31 and/or throat surfaces 12*b* are such that a "snap-fit" between the parts is achieved. The groove 32 imparts the desired resiliency to the pads 31.

Other arrangements may be used to hold the stirrups into the receptacles. For example, the engaging surfaces may be such that frictional contact is sufficient. Also, simply wrapping the cable during tensioning with the stirrup throat squeezed between turns is a useful arrangement. Again, a principal advantage of the stirrup-securing system is to hold the elements of the exerciser in proper position when there is no stress on the cable.

Referring to FIG. 5, a conventional curl exercise is depicted. In the exercise shown, the exerciser places his feet in the stirrups 12 and grasps the lifting bar 17 with the palms up. The exerciser rolls the bar to wrap turns of the cable circumferentially about the bar ends to achieve a desired tension. The exerciser may then performs a series of repetitions in lifting the bar 17 upwards.

The exerciser described above avoids a problem found in earlier devices of this type; namely, the tendency of the bar to rotate under tension when the cable is wrapped about the bar. For example, when doing curls the feet are placed in the stirrups and the bar is rotated to shorten the cable runs at each end of the bar. Then, in contrast to earlier devices, the cable runs at either end of the bar are extended between the adjacent and then upright pairs of lugs 24. The cable runs then extend down to the stirrups at either end of the bar with the cable runs forced between the lugs 23 at each end of the bar. The cable runs are held centrally and captively within each yoke 21. When the cables are now tensioned by performing curls the bar will not tend to rotate and dangerously slip out of the user's hands.

The exerciser of the invention 10 is provided with a door attachment device 40 that significantly increases the versatility of the exerciser. As shown in FIG. 1, the device includes a relatively rigid extension 41 that includes an aperture 42 for receiving the cable. The aperture 42 includes sufficiently extended and curved bearing surfaces such that the cable is not overstressed during operation. The extension 41 includes an aperture 43 at its opposite end through which is looped one end of a door jamb attachment strap 44. The strap is preferably a strong, yet flexible webbing material, such as braided nylon. The use of a flexible webbing substantially reduces the possibility of damage to the door and jamb surfaces. The use of a very strong webbing that is resistant to damage is important to the safe use of the device, The strap includes an enlargement 45 on its end that is sized to fit between a door that is partially open and a door jamb. The enlargement 45 is passed beyond the door. The door is then closed with the enlargement 45 securely held against the closed door and the jamb such that the enlargement cannot be pulled through the very narrow crack remaining after the door is closed. The exerciser is thus operable without damaging the door or jamb. A preferred form of the enlargement 45 is a portion of webbing that is rolled into a cylinder and sewn into the end of the webbing strap 44. The rolled web may be heat treated to stabilize and consolidate the enlargement where the webbing is a temperature-sensitive material.

Referring to FIG. 6, an exercise using the door attachment device is shown in which the lifting bar is removed and both stirrups 12 of the device of the invention are fastened to a belt 46 about the user's waist. The arrangement permits the exerciser to run against the force of the cable, performing a treadmill-type exercise.

Referring to FIG. 4, the aperture 13 has tapered surfaces which form bearing surfaces for engaging the outer surface of the cable 11. A cable securing provision includes an end plug 15 which includes surfaces complimentary in shape to the stirrup aperture 13. The plug 15 perferably also includes a bearing shoulder 16 that engages the bearing supporting surfaces 14 surrounding the stirrup aperture 13. The plug 15 is inserted in the end of the elastic cable 11 oriented such that tensioning of the cable pulls the end plug into snug contact with the stirrup apertures with the cable squeezed therebetween. The aperture bearing surfaces 14 and shoulder 16 provided on the plug 15 provide a positive stop for holding the cable end 11 and stirrup 12 together. The end plug 15 is dimensioned such that the frictional forces between the cable and plug and aperture are not exceeded by the tension on the cable during use.

From the foregoing, it will be appreciated that, although embodiments of the invention have been described herein for purposes of illustration, various modifications may be made without deviating from the spirit and scope of the invention. Accordingly, the invention is not limited except as by the appended claims.

I claim:

1. An exercise apparatus, comprising:

an elastic cable having an untensioned diameter;

a pair of stirrups, one fastened to each end of said cable; and an elongated bar, each end provided with a generally U-shaped yoke that receives and guides an intermediate portion of said cable to hold said stirrups apart, each said yoke including opposed projections extending inwardly into the yoke opening so as to form a gap smaller than the untensioned diameter of the cable to removably retain said cable in said yoke when the cable is untensioned.

2. The apparatus of claim 1, including two fingers extending longitudinaly from each end of said elongated bar to define said yoke, wherein each said finger includes two opposed lugs projecting transversely from said finger and said projection to prevent the cable, circumferentially wrapped for tensioning about the bar ends, from slipping off the bar end when the cable is tensioned.

3. An exercise apparatus, comprising:

an elastic cable;

a pair of stirrups having engagement surfaces and fastened to each cable end; and an elongated bar, including a yoke at each end for engaging an intermediate portion of said cable, the bar further including at each bar end a receptacle aligned with said yoke with the cable passing therethrough, said receptacle having receiving means for receiving and engaging the stirrup-engagement surfaces such that said stirrups is held fixed to said bar without tensioning said cable.

4. The apparatus of claim 3 wherein said sitrrup-engagement surfaces include a throat portion to which said cable is fastened and said throat portion is engaged by said receptacle.

5. The apparatus of claim 4 wherein said receptacle includes engaging pads that urge said stirrup throat into frictional contact with opposed receptacle surfaces.

6. The apparatus of claim 4 wherein said stirrup throat is tapered, said engaging pads are the compliment of said throat surfaces and said lugs slightly resilient such that said stirrup snap fits into engagement with said receptacle surfaces.

7. An exercise apparatus, comprising:

an elongated elastic member;

a pair of stirrups fastened to the elongated elastic member; and an elongated bar defining a longitudinal axis and having two ends, each end having two longitudinal extending fingers defining a yoke for receiving and guiding a portion of the elongated elastic member, each finger having two lugs extending transversely in opposite directions to prevent the elongated elastic member from slipping off the bar ends when the elongated elastic member is circumferentially wrapped for tensioning thereabout.

* * * * *

UNITED STATES PATENT AND TRADEMARK OFFICE

CERTIFICATE OF CORRECTION

PATENT NO. : 4,779,867

DATED : October 25, 1988

INVENTOR(S) : Robert S. Hinds

It is certified that error appears in the above-identified patent and that said Letters Patent is hereby corrected as shown below:

In claim 4, column 6, line 15, delete "sitrrup" and substitute therefor --stirrup--.

Signed and Sealed this

Ninth Day of May, 1989

*Attest:*

DONALD J. QUIGG

*Attesting Officer*

*Commissioner of Patents and Trademarks*